US006006652A

United States Patent [19]

Peng

[11] Patent Number: 6,006,652

[45] Date of Patent: Dec. 28, 1999

[54] AUTOMOTIVE REFRIGERANT WOBBLE PLATE TYPE COMPRESSOR PISTON WITH IMPROVED BALL AND SOCKET JOINT

[75] Inventor: Yuan Hong Peng, E. Amherst, N.Y.

[73] Assignee: General Motors Corporation, Detroit, Mich.

[21] Appl. No.: 09/182,923

[22] Filed: Oct. 30, 1998

[51] Int. Cl.[6] ..... F04B 1/20

[52] U.S. Cl. ..... 92/71; 92/158; 92/187; 91/499

[58] Field of Search ..... 92/153, 154, 158, 92/181 R, 187, 71; 417/269; 91/499

[56] References Cited

U.S. PATENT DOCUMENTS

| | | | |
|---|---|---|---|
| 2,964,365 | 12/1960 | Hausch | 403/122 |
| 3,191,264 | 6/1965 | Underwood et al. | 29/509 X |
| 3,437,015 | 4/1969 | Kubilos | 91/499 X |
| 3,905,281 | 9/1975 | Clerk | 92/158 X |
| 3,978,772 | 9/1976 | Miyao et al. | 92/158 |
| 4,070,122 | 1/1978 | Wisner | 92/187 X |
| 4,111,103 | 9/1978 | Mauch | 92/153 X |
| 4,174,191 | 11/1979 | Roberts | 417/269 X |
| 4,359,933 | 11/1982 | Fricke | 91/158 X |
| 4,382,399 | 5/1983 | Lotter | 91/499 X |
| 4,637,293 | 1/1987 | Yamaguchi et al. | 91/499 X |
| 4,747,203 | 5/1988 | Yukita et al. . | |
| 4,893,548 | 1/1990 | Kawahara et al. | 92/71 X |
| 4,905,577 | 3/1990 | Schneeweiss | 92/158 |
| 5,114,261 | 5/1992 | Sugimoto et al. | 417/269 X |
| 5,137,431 | 8/1992 | Kiyoshi et al. | 417/269 |
| 5,520,088 | 5/1996 | Dixen | 92/71 |
| 5,720,215 | 2/1998 | Asplund et al. . | |

FOREIGN PATENT DOCUMENTS

H1-71178 of 1989 Japan .

*Primary Examiner*—John E. Ryznic
*Attorney, Agent, or Firm*—Patrick M. Griffin

[57] ABSTRACT

A wobble plate compressor piston has a central aperture formed through its front surface, directly into the ball and socket joint that connects it to the drive plate. High pressure refrigerant and entrained lubricant mist are forced into the gap between ball and socket, collecting in a converging section thereof to form a liquid seal that prevents blow by of refrigerant gas and compression loss. The joint is better lubricated as a consequence, reducing stress on the connecting rod.

3 Claims, 5 Drawing Sheets

AUTOMOTIVE REFRIGERANT WOBBLE PLATE TYPE COMPRESSOR PISTON WITH IMPROVED BALL AND SOCKET JOINT

TECHNICAL FIELD

This invention relates to wobble plate type piston compressors, and specifically to an improved ball and socket joint for such a compressor.

BACKGROUND OF THE INVENTION

Piston driven automotive air conditioning compressors all draw in and compress a mixture of refrigerant vapor and entrained lubricant within a close fitting cylinder, as the piston is driven axially back and forth. The lubricant entrained in the refrigerant vapor provides a lubricating film to those moving parts and interfaces to which it is exposed. In extreme conditions, some liquid refrigerant may be drawn into the cylinder, which is not nearly so compressible as vapor. This settles preferentially in the lower cylinders, and its resistance to compression as the piston is driven forward is generally referred to as "slugging."

Piston compressors typically fall into one of two broad categories based on the piston drive means, swash plate or wobble plate. Any piston compressor has to have a sliding interface between the piston and the drive means, since the drive means rotates with the shaft and the piston does not, and that sliding interface is located differently within these two broad compressor types. In a swash plate compressor, a single slanted plate rotates one to one with the drive shaft, and the edge of the one-piece plate slides through a slot in the back of each piston, supported by sliding shoes. An example may be seen in co assigned U.S. Pat. No. 5,720,215.

In a wobble plate compressor, an example of which is illustrated in FIG. 1, a compressor housing 10 encloses a crankcase chamber 12 located behind a cylinder block 14. Cylinders 16 formed in the block 14 are arrayed around the axis of the central rotating drive shaft 18. The drive means consists of two plates, a primary plate 20 that rotates directly, one to one, with the shaft 18, and a secondary plate 22 supported by rolling bearings 24 on the primary plate 20. The primary plate 20 drives the secondary plate 22 back and forth in a nutating or "wobbling" motion, but the secondary plate 22 does not rotate itself. Therefore, each piston 26 can be directly connected to the secondary plate 22, typically by a rod 28 with a ball 30, 32 at each end. Each ball 30, 32 is received in a socket joint, one socket 34 formed in the secondary plate 22, and one socket 36 formed integrally with the back of the piston 26. Piston 26 is typically formed of an aluminum alloy sufficiently malleable to allow the socket 36 to be integrally deformed around ball 30. As the plates 20 and 22 nutate, the connecting rod 28 tilts on and off the axis of the cylinder 16 as the balls 30, 32 twist within their respective sockets 34, 36.

Each type of compressor faces unique problems and issues. In the swash plate compressor, the piston is much larger, with a cylindrical front surface or head that does the actual compressing within the cylinder, and a rear body that extends from the head all the way back to the drive plate. This represents a good deal of material and mass, and several patents provide hollow or near hollow piston designs to remove weight. The rear of the piston body extends out of the cylinder and into the compressor housing or crankcase chamber, where it can turn far enough to rub on the housing wall. The above noted patent provides a piston designed to minimize that rubbing wear. Lubrication of the sliding interface between shoes and swash plate is an issue, but the interface is generally well enough exposed to refrigerant vapor and lubricant within the crank chamber to avoid excessive wear. If not, either the shoe or the plate surface can be coated with any number of existing wear resistant bronze alloys, by several conventional methods. The rotating joint between the shoes and the pistons is also generally well exposed to a refrigerant-lubricant mist, since only half or less of the spherical surface area of the shoe is embedded into the piston socket.

In a wobble plate compressor, the piston is much shorter axially, only about the size of the front head of a swash plate compressor piston. It is inherently lighter and simpler to manufacture, and does not extend out of the cylinder at all. The most significant problem recognized in the prior art relevant to a wobble plate compressor piston is the problem of friction and wear in the piston-connecting rod ball and socket joint. Since the socket has to wrap significantly around and past the equator or center plane of the connecting rod ball, the turning interface between ball and socket is not well exposed to the refrigerant-lubricant mist in the crank chamber. In the event that slugging increases the pressure on the piston, arid the consequent normal contact force between the ball and the socket, the increased frictional force in the joint can stress the connecting rod as it tilts off the cylinder axis.

The prior art recognizes the problem of providing lubrication to the piston ball and socket joint. Since the piston is exposed at the front to the compression space in the cylinder, that represents a possible source of lubricant for its ball and socket joint. However, the industry is apparently unanimous in its judgment that the only practicable means of introducing lubricant from the cylinder compression space to the piston's socket joint is by providing an indirect passage from the cylinder compression space to the socket, so as to throttle down the pressure. For example, in the design disclosed in Japanese UM No. 01-71178, shown in FIG. 2, the piston 38 has a series of oblique passages 40 cut through the side wall, just under the piston ring seals 42, and opening into the socket 44. Oddly, the socket 44 as disclosed does not wrap around the ball 46 sufficiently to even be workable, although other figures show it differently. The clear purpose is to open a path from just under the seals 42 to the socket 44 for lubrication, but without being exposed directly to the high pressure in front of the piston 38.

This same intent is evidenced in the design shown in U.S. Pat. No. 5,137,431, shown in FIG. 3. Here, the design in the Japanese UM noted above is recognized, but it is claimed that the path shown there is still too direct. It is claimed that "Smooth movement of the ball portion within the spherical concavity is prevented by the undesirable high pressure of the refrigerant gas. Consequently, abnormal wearing of the inner surface of the spherical concavity and the outer surface of the ball portion is experienced." It is also claimed that such high pressure would actually decrease the amount of oil reaching the socket. Accordingly, it is proposed to provide a similar oil passage 48, but opening between the two ring seals 50, so as to throttle down the high pressure from the cylinder before it reaches the socket joint. In another embodiment, the diameter of the passage is actually decreased to a very small size before entering the socket, so as to further throttle down the pressure.

As to the opposite socket joint, that formed in the secondary drive plate, many designs do show a central hole opening to the center of the ball socket. An example may be seen in U.S. Pat. No. 4,747,203. The hole is not intended as an oil or lubricant passage, however, despite its appearance, but is simply a remnant of the method by which the socket is formed. A push pin impacts the ball when the integral socket is formed, in order to create a small gap between the ball and socket, although the shape and detail of the claimed gap is not disclosed. The through hole is simply left when the pin is withdrawn. There would be no pressure differential within the crankcase to force oil into such a through hole, in any event, so that its effect in improving lubrication would be minimal.

SUMMARY OF THE INVENTION

The invention provides a rare example of a design which runs directly counter to the teachings of the prior art, doing the very thing that is taught to be unworkable, and discovering that it in fact works better, at least for the type of socket joint disclosed.

In the preferred embodiment disclosed, a wobble plate compressor piston of conventional shape, size and material is joined to a connecting ball by an integrally formed socket. The socket is formed from the material of the piston in such a way as to wrap around and past the equator of the ball, but with the socket widened slightly around the equator so as to leave a small gap relative to the surface of the ball. This gap converges moving toward a terminal lip of the socket, which lip directly engages the rear half surface of the ball. A central aperture is formed through the front surface of the piston to and into the socket, deliberately providing a direct path for high pressure compressed refrigerant (and the lubricant mist entrained therein) to the socket and ball interface. Lubricant blown into the socket and its internal gap is forced into and trapped in the converging portion of the gap, providing superior lubrication of the interface. However, the trapped lubricant also creates a liquid seal that prevents the high pressure refrigerant from blowing by and out of the socket, which would reduce the compression efficiency. In addition, at very high pressure conditions, it is thought that pressure reaching and acting the front half surface of the ball actually reduces the normal contact force at the ball-socket surface interface, thereby reducing the frictional force as well. Performance, evidenced by reduced structural failure of the connecting rods, is enhanced, with no reduction in compression efficiency.

DESCRIPTION OF THE PREFERRED EMBODIMENT

Figure 1:
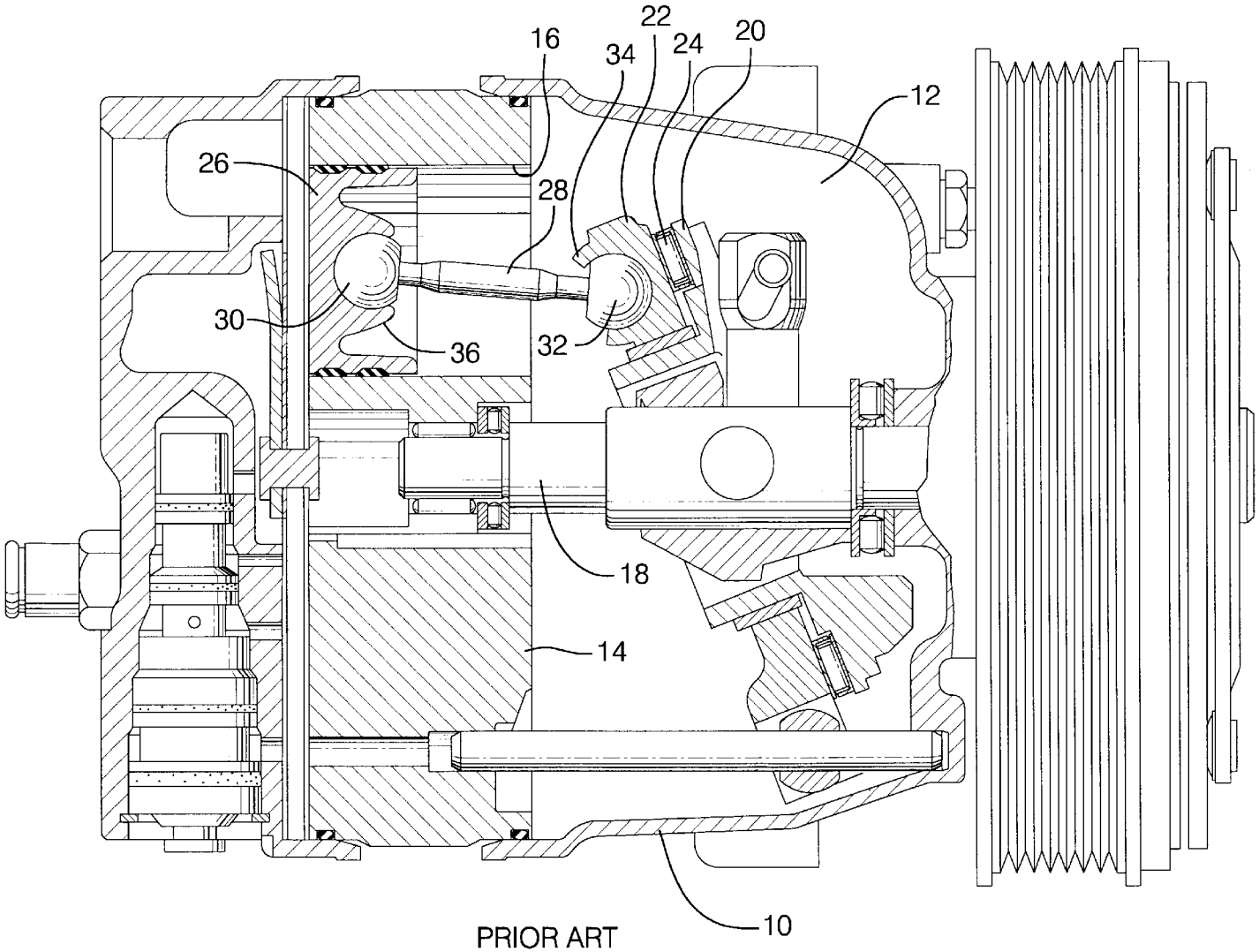
PRIOR ART FIG. 1
FIG. 1 is a view of a typical wobble plate compressor of the type in which the improved piston of the invention is incorporated.
Figure 2:
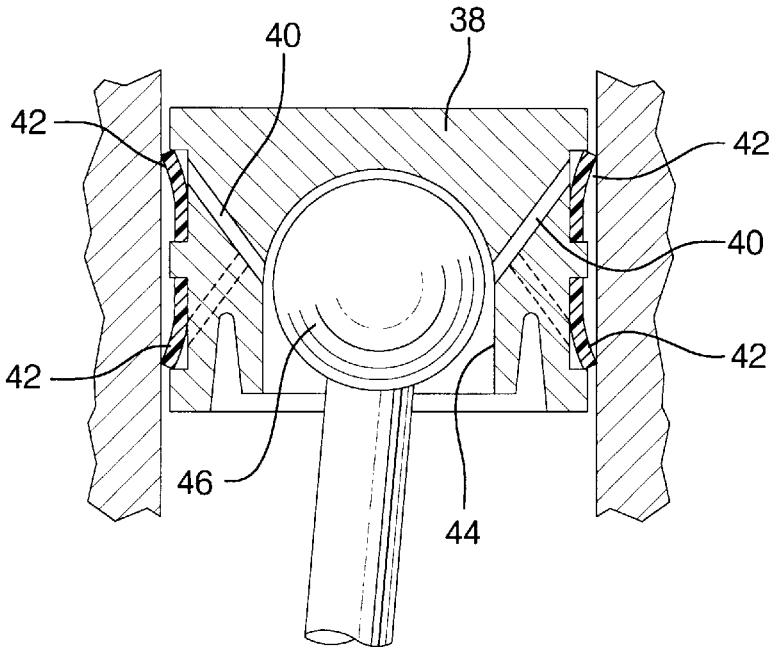
PRIOR ART FIG. 2
FIG. 2 is a prior art socket joint as described above.
Figure 3:
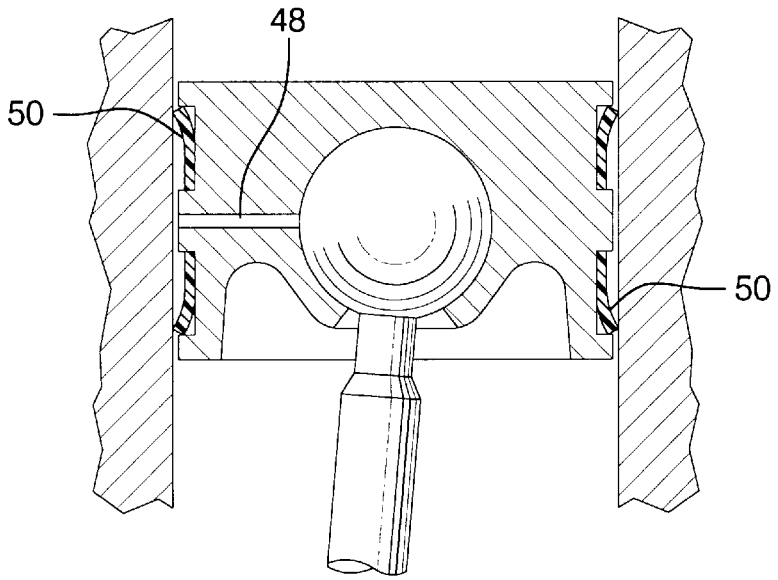
PRIOR ART FIG. 3
FIG. 3 is another prior art socket joint as described above.
Figure 4:
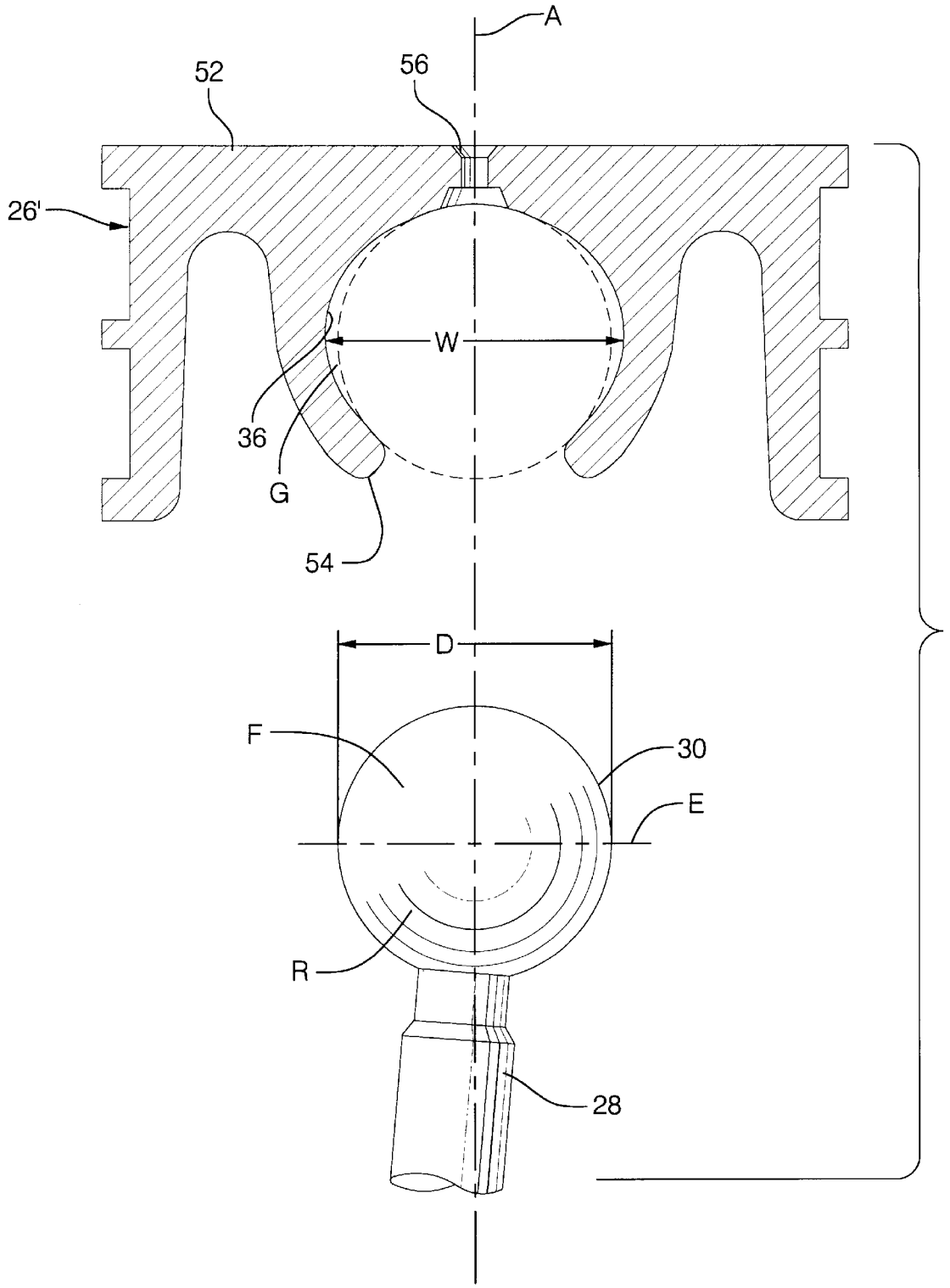
FIG. 4 is a disassembled socket joint according tD the invention.
Figure 5:
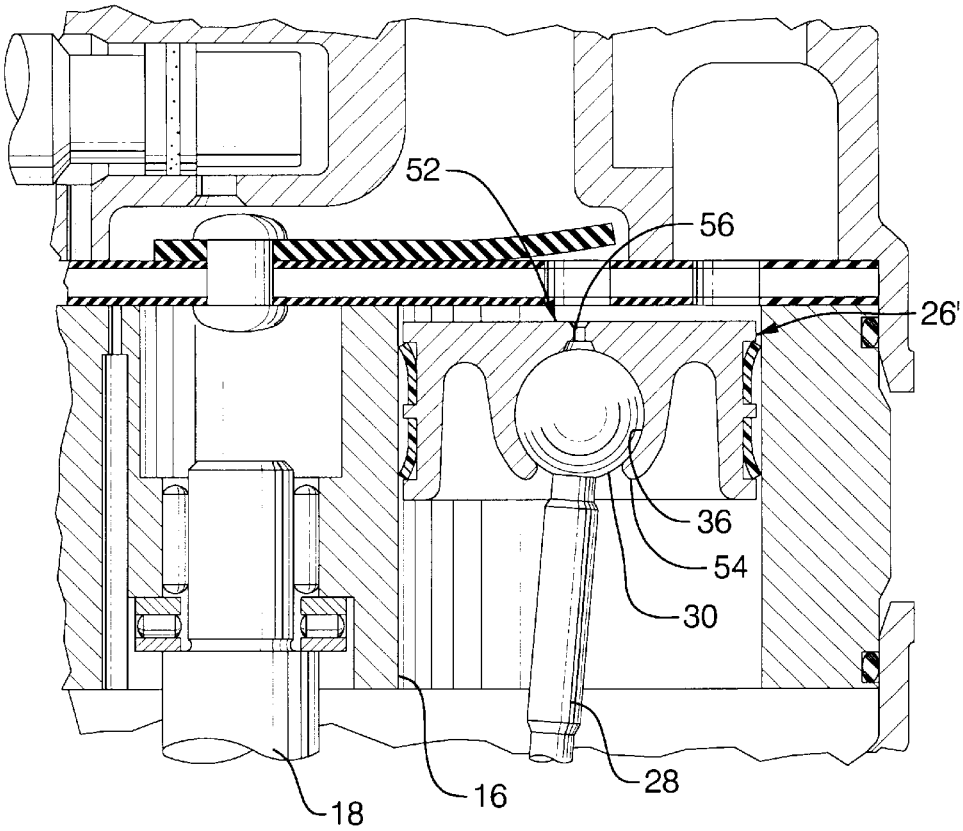
FIG. 5 is a view of a piston and socket joint according to the invention incorporated in a compressor.
Figure 6:
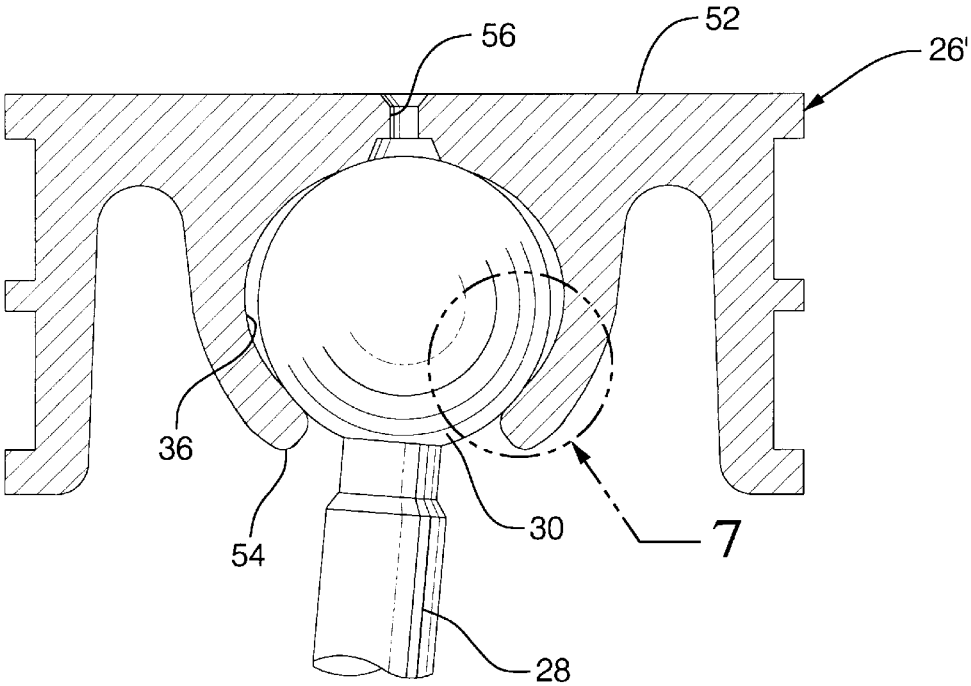
FIG. 6 is an enlarged view of the socket joint.

Referring first to FIGS. 4, 5 and 6, a piston according to the invention is incorporated in the same type of wobble plate compressor described above, and corresponding components and parts thereof are given the same number. Only the piston differs, but even it has the same shape, material and basic size, and is given the same number primed. Additional detail of piston 26' is described which, again, does not differ from piston 26 described above, but which is especially relevant to the improvement of the invention. Specifically, piston 26' includes a front surface 52, as does any piston, which is the surface directly exposed to and acting upon the high pressure refrigerant and lubricant mist within cylinder 16 as piston 26' is advanced. The ball 30 can be conveniently subdivided into a front half surface F and a rear half surface R, defined relative to an equator E that is perpendicular to the center axis A of cylinder 16 and piston 26'. The axis of rod 28 is shown coaxial to axis A in FIG. 4, although in operation it will generally be tilted away from it, as shown in FIG. 5. The socket 36 formed integrally with the back of the piston 26' wraps around the ball equator E to grasp the ball rear surface R. The socket 36 is formed in such a way that its internal width W, near the equator E, is slightly wider than the diameter D of the ball 30, creating a gap G. The gap is exaggerated in the drawing for illustration. The terminal lip 54 of socket 36 directly contacts the ball rear surface R, and the top center portion of the inner surface of socket 36 directly contacts the top center portion of ball 30. The gap G converges to the outer surface of ball 30, moving in both directions away from the equator E, where it is widest. Again, these structural details are common to the prior art piston 26 and the current piston 26'.

Figure 7:
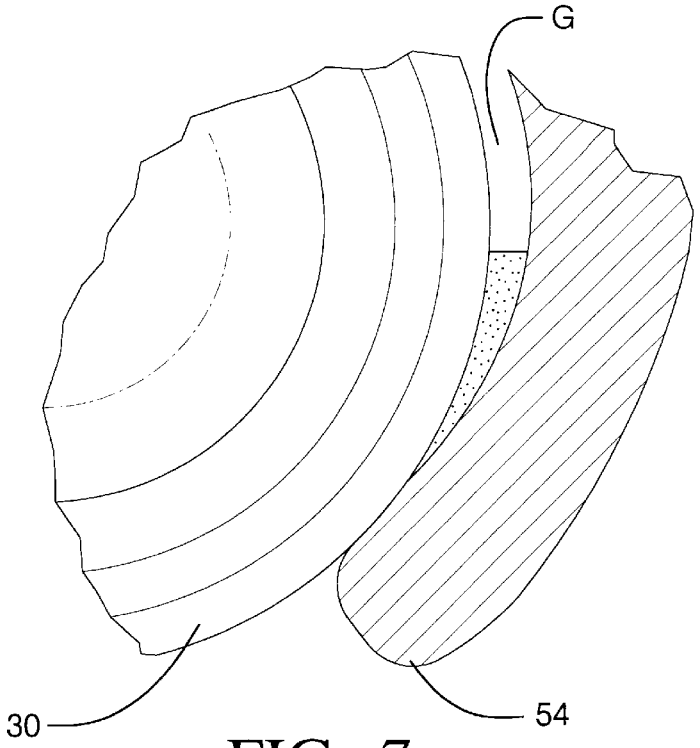
FIG. 7 is an enlarged portion of FIG. 7.
Figure 8:
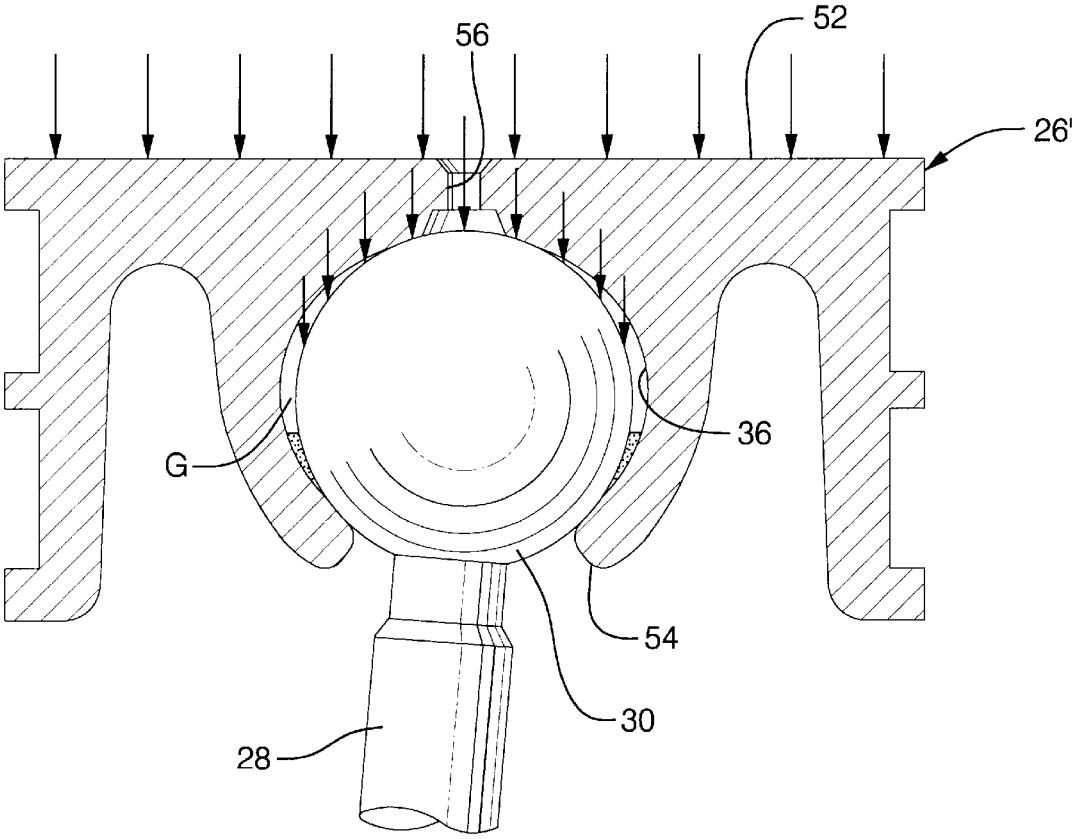
FIG. 8 is a view similar to FIG. 6, schematically showing the pressure acting on the piston and the joint.

Referring next to FIGS. 6, 7 and 8, the structural difference between piston 26 and 26', while apparently simple, is in fact a dramatic change, since it flies directly in the face of the clear teaching of the prior art as to what would and would not work. A central aperture, indicated generally at 56, is bored through the piston front surface 52, opening directly from the cylinder 16 and into the socket 36 and the gap G, and also exposed directly to the front half surface F of ball 30. The aperture 56 is flared conically at the top, with a diameter D1, and at the rear, with a wider diameter D2. A review of the teaching of the prior art referred to above indicates just how great a departure from the teachings of the art this is. A path is directly and deliberately opened from the high pressure volume in the front of the cylinder 16 to and into the socket 36. No attempt is made the throttle the pressure down, and, in fact, the aperture 56 is widened at top and bottom. The prior thinking was that such a piston could not work, because the high pressure refrigerant from cylinder 16 would simply blow through the gap G and past the socket terminal lip 54 to severely reduce the compression efficiency. Also, the art taught that such a direct pressure path would impair that operation of the ball and socket joint. In fact, testing showed no appreciable reduction in compression efficiency. What occurred in fact was that the lubricant mist entrained in the high pressure refrigerant was trapred in the rear converging section of the gap G, by the lip 54, forming a liquid seal to prevent blow by. While there was no apparent loss of compression, additional lubricant was forced into the gap G to prevent friction and wear between the outer surface of ball 30 and the inner surface of socket 36. Moreover, as illustrated in FIG. 8, the unimpeded entry of high pressure refrigerant through the aperture 56 and against the ball front half surface F apparently serves to relieve the normal contact force that would otherwise occur between the ball front half surface F and the upper portion of the inner surface of socket 36. This, too, reduces the frictional force, preventing seizure and reducing stress on the connecting rod 28 during high pressure conditions, such as liquid slugging. In conclusion, the aperture 56 did nothing significant to impair compression, and improved the operation of the ball and socket joint noticeably.

Variations in the disclosed embodiment could be made. The aperture 56 need not necessarily be placed in all pistons, and might be used simply on the lowermost piston, since it is the lowermost cylinder where liquid refrigerant preferentially collects. The aperture need not necessarily be central, nor even necessarily a single aperture, so long as it opens directly through the piston top surface and into the socket gap G. The aperture could have a single diameter, although it is thought that the conical flaring and top and bottom improves its efficiency. Therefore, it will be understood that it is not intended to limit the invention to just the embodiment disclosed.

I claim:

1. In a wobble plate type automotive air conditioning compressor having at least one cylinder and a close fitting piston having a front surface driven axially forward and back within said cylinder by a connecting rod and ball contained in an integral socket joint in said piston, and in which said socket is the type in which the material of said piston is deformed around said ball in such a way as to leave an internal gap between said socket and ball centered on the equator of said ball that converges toward a terminal lip of said socket, and in which the front surface of said piston compresses a mixture of refrigerant vapor and entrained liquid lubricant as it is driven forward, the improvement comprising, an aperture formed through the front surface of and opening directly into said socket, whereby high pressure refrigerant and entrained lubricant are forced directly through said central aperture and into said socket, thereby lubricating said ball and socket joint and also collecting in said converging gap to form a liquid seal that substantially prevents the escape of pressurized refrigerant out of said socket.

2. In a wobble plate type automotive air conditioning compressor having at least one cylinder and a close fitting piston having a front surface driven axially forward and back within said cylinder by a connecting rod and ball contained in an integral socket joint in said piston, and in which said socket is the type in which the material of said piston is deformed around said ball in such a way as to leave an internal gap between said socket and ball centered on the equator of said ball that converges toward a terminal lip of said socket, and in which the front surface of said piston compresses a mixture of refrigerant vapor and entrained liquid lubricant as it to is driven forward, the improvement comprising, a centrally located aperture formed through the front surface of and opening directly into said socket and centrally to the front half surface of said ball, whereby high pressure refrigerant and entrained lubricant are forced directly through said central aperture and into said socket, thereby lubricating said ball and socket joint and also collecting in said converging gap to form a liquid seal that substantially prevents the escape of pressurized refrigerant out of said socket, and whereby high pressure refrigerant impinges directly and centrally on the front half surface of said ball to reduce the contact force between said ball and socket.

3. In a wobble plate type automotive air conditioning compressor having at least one cylinder and a close fitting piston having a front surface driven axially forward and back within said cylinder by a connecting rod and ball contained in an integral socket joint in said piston, and in which said socket is the type in which the material of aid piston is deformed around said ball in such a way as to leave an internal gap between said socket and ball centered on the equator of said ball that converges toward a terminal lip of said socket, and in which the front surface of said piston compresses a mixture of refrigerant vapor and entrained liquid lubricant as it is driven forward, the improvement comprising, a centrally located aperture formed through the front surface of and opening directly into said socket and centrally to the front half surface of said ball, said aperture being conically flared at each end, whereby high pressure refrigerant and entrained lubricant are forced directly through said central aperture and into said socket, thereby lubricating said ball and socket joint and also collecting in said converging gap to form a liquid seal that substantially prevents the escape of pressurized refrigerant out of said socket, and whereby high pressure refrigerant impinges directly and centrally on the front half surface of said ball to reduce the contact force between said ball and socket.

* * * * *